US008359678B1

(12) United States Patent
Burdette

(10) Patent No.: US 8,359,678 B1
(45) Date of Patent: Jan. 29, 2013

(54) URINAL BRACKET EXTENSION PLATE

(76) Inventor: Christopher L. Burdette, Gibson City, IL (US)

( * ) Notice: Subject to any disclaimer, the term of this patent is extended or adjusted under 35 U.S.C. 154(b) by 0 days.

(21) Appl. No.: 13/409,444

(22) Filed: Mar. 1, 2012

(51) Int. Cl.
*E03D 11/00* (2006.01)

(52) U.S. Cl. ..... 4/252.2

(58) Field of Classification Search ..... 4/252.1–252.6, 4/307, 301, 310–312; 285/64; 381/306; 249/91, 93, 205; 52/699, 700; 248/284, 248/300, 314, 291, 293; 411/107
See application file for complete search history.

(56) References Cited

U.S. PATENT DOCUMENTS

| | | | | | |
|---|---|---|---|---|---|
| 1,331,018 | A * | 2/1920 | Luthy | 429/143 |
| 3,490,727 | A * | 1/1970 | Miller | 248/284.1 |
| 3,667,714 | A * | 6/1972 | Ziaylek, Jr. | 48/284.1 |
| 3,742,522 | A * | 7/1973 | Stevenson | 4/307 |
| D312,382 | S * | 11/1990 | Ryll | D8/349 |
| 4,982,455 | A * | 1/1991 | Carter | 4/307 |
| 5,014,953 | A * | 5/1991 | Warnan et al. | 248/284.1 |
| 5,206,961 | A * | 5/1993 | Ruegg | 4/252.3 |
| 6,047,515 | A * | 4/2000 | Behlen | 52/699 |
| 6,065,730 | A * | 5/2000 | Marks et al. | 248/314 |
| 6,922,968 | B1 * | 8/2005 | Behlen | 52/699 |
| 2008/0029669 | A1 * | 2/2008 | Olah et al. | 248/276.1 |
| 2008/0283694 | A1 * | 11/2008 | VanLanen et al. | 248/133 |
| 2009/0101780 | A1 * | 4/2009 | Revelino et al. | 248/274.1 |
| 2010/0000173 | A1 | 1/2010 | Thompson | |
| 2010/0101284 | A1 * | 4/2010 | Varney et al. | 70/57 |
| 2011/0198456 | A1 * | 8/2011 | Fiedler | 248/122.1 |
| 2012/0134519 | A1 * | 5/2012 | Caldes et al. | 381/306 |

* cited by examiner

*Primary Examiner* — Lori Baker

(57) ABSTRACT

A bracket system for improving the speed and ease of mounting a urinal using a standard urinal carrier. A carrier wall base comprises a carrier first mount having a plurality of bolts, and a carrier second mount having a plurality of bolts. The carrier first mount connects to a first bracket base plate that comprises a plurality of apertures. A first telescopic connector slidably connects the first bracket base plate to a first bracket extension plate. The carrier second mount connects to a second bracket base plate that comprises a plurality of apertures. A second telescopic connector slidably connects the second bracket base plate to a second bracket extension plate.

7 Claims, 4 Drawing Sheets

URINAL BRACKET EXTENSION PLATE

BACKGROUND OF THE INVENTION

Urinals have been used in various forms for many years. To properly install a urinal, a carrier bracket is often used. Sometimes during the installation the threaded bolts extending from the carrier bracket can become damaged and misaligned which slows down the installation process. The present invention teaches a system to improve the speed and ease of mounting a urinal using a standard urinal carrier.

SUMMARY

The present invention features a bracket system for improving the speed and ease of mounting a urinal using a standard urinal carrier comprising a standard urinal carrier having a planar carrier wall base located on a vertically projecting carrier first leg and a vertically projecting carrier second leg.

In some embodiment, the carrier wall base comprises a carrier first mount having a plurality of bolts located on it according to a first side pattern. In some embodiments, the first side pattern is a mated set with a first urinal mount. In some embodiments, the carrier wall base comprises a carrier second mount having a plurality of bolts located on it according to a second side pattern. In some embodiments, the second side pattern is a mated set with a second urinal mount.

In some embodiments, the system comprises a planar first bracket base plate that comprises a plurality of apertures located on it according to the first side pattern. In some embodiments, the system comprises a first bracket extension plate that comprises a plurality of bolts located on it according to the first side pattern. In some embodiments, the system comprises a first telescopic connector. In some embodiments, the first bracket base plate and the first bracket extension plate are slidably connected via the first telescopic connector.

In some embodiments, the system comprises a planar second bracket base plate that comprises a plurality of apertures located on it according to the second side pattern. In some embodiments, the system comprises a second bracket extension plate that comprises a plurality of bolts located on it according to the second side pattern. In some embodiments, the system comprises a second telescopic connector. In some embodiments, the second bracket base plate and the second bracket extension plate are slidably connected via the second telescopic connector.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
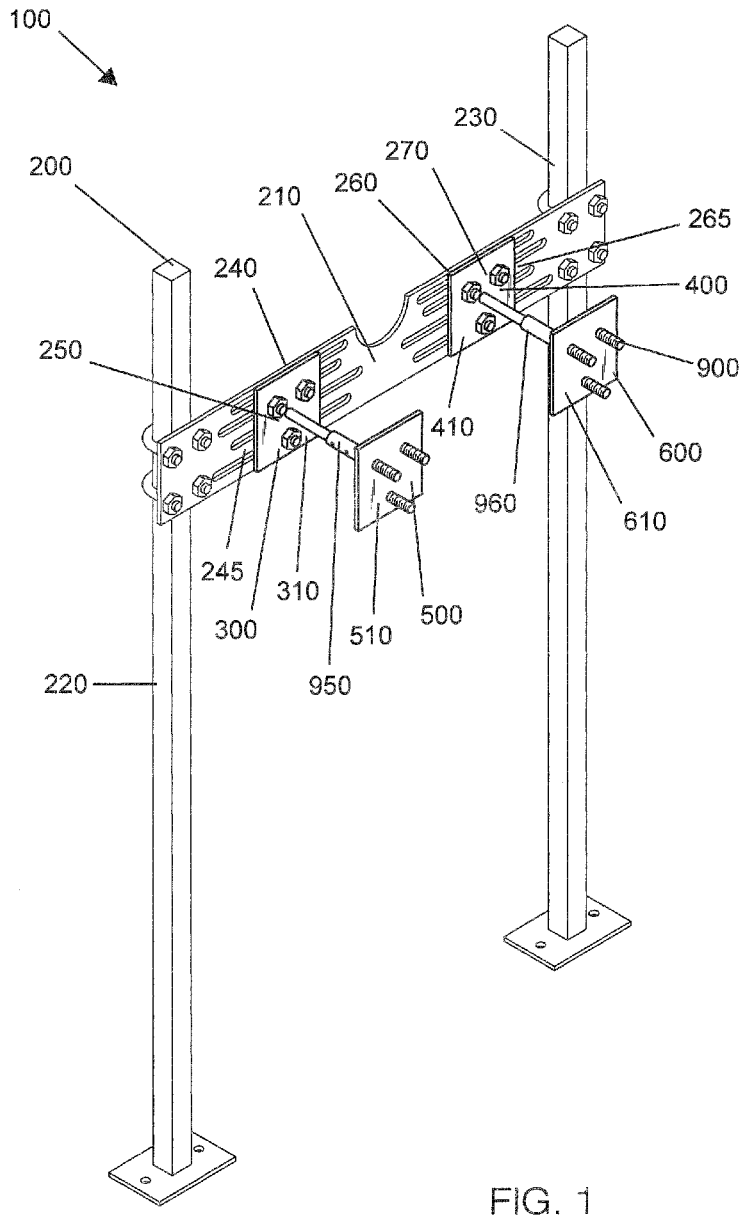
FIG. 1 is a perspective view of the present invention.
Figure 2:
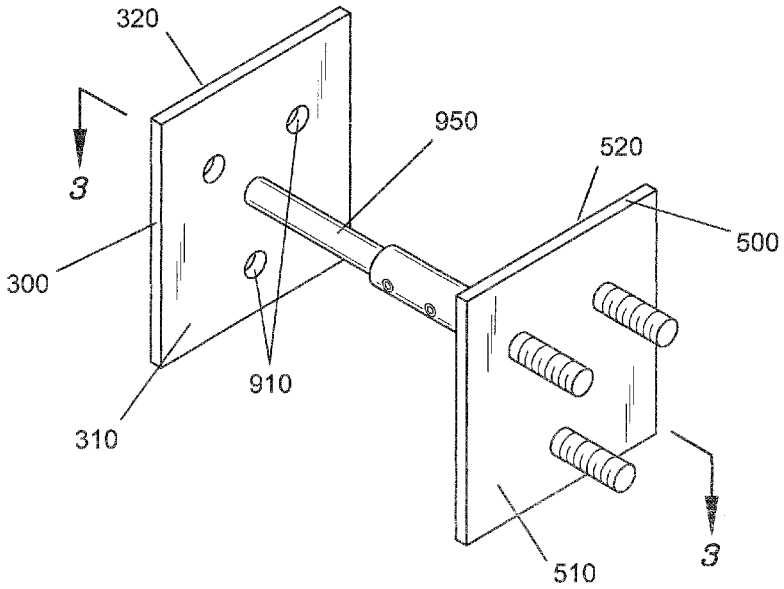
FIG. 2 is a perspective view of the first bracket base plate, first bracket extension plate, and first telescopic connector of the present invention.
Figure 3:
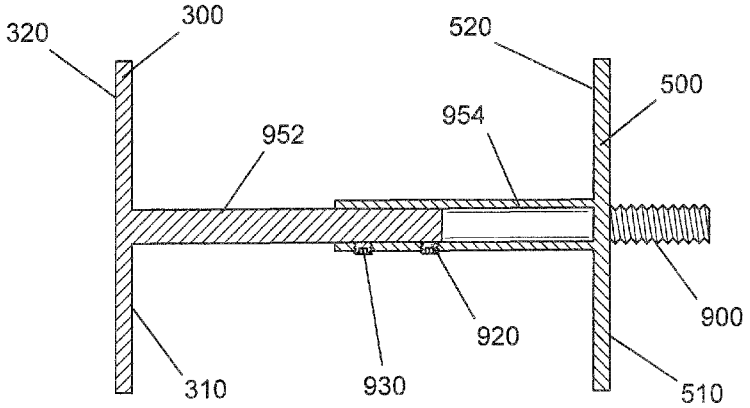
FIG. 3 is a top cross-sectional view of the first bracket base plate, first bracket extension plate, and first telescopic connector of the present invention.
Figure 4:
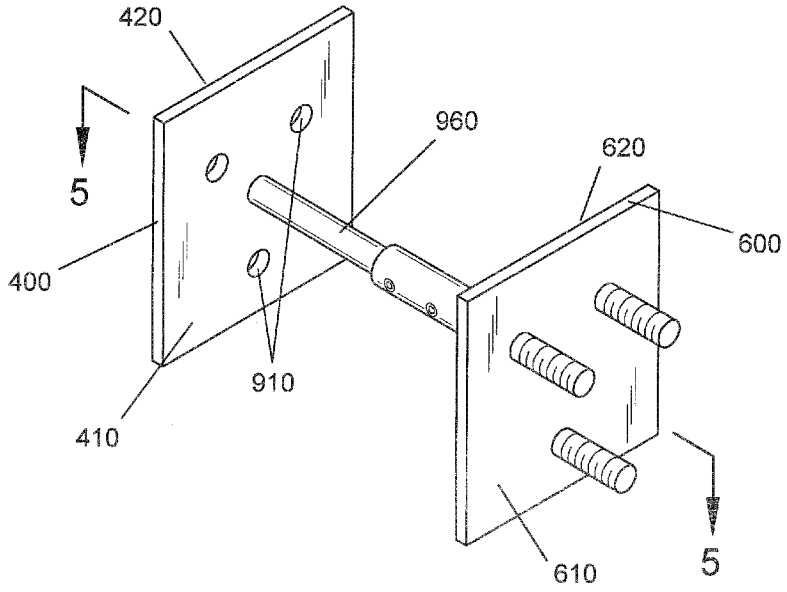
FIG. 4 is a perspective view of the second bracket base plate, second bracket extension plate, and second telescopic connector of the present invention.
Figure 5:
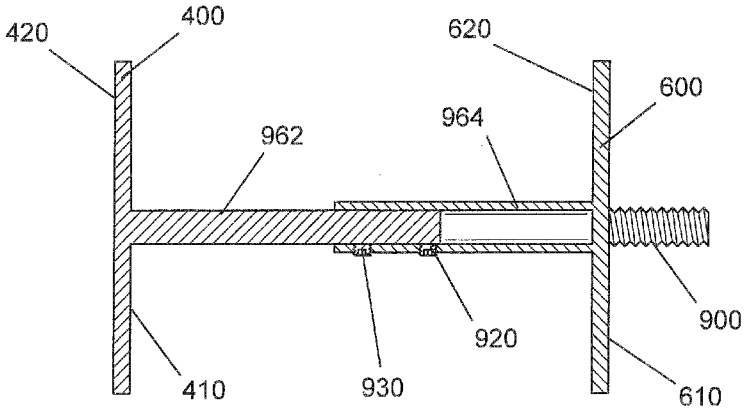
FIG. 5 is a top cross-sectional view of the second bracket base plate, second bracket extension plate, and the second telescopic connector of the present invention.
Figure 6:
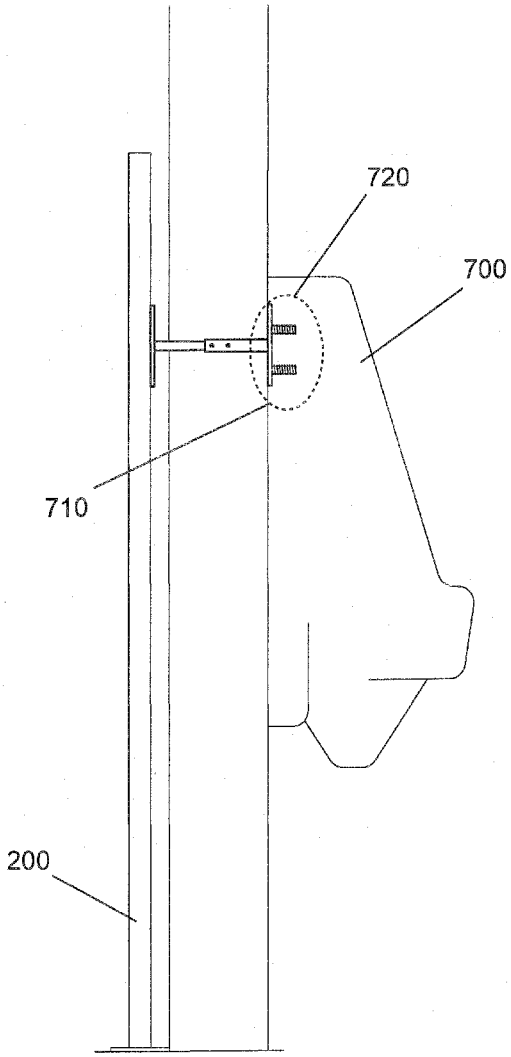
FIG. 6 is a cross-sectional view of the present invention as installed.

Following is a list of elements corresponding to a particular element referred to herein:

100 Bracket system
200 Standard urinal carrier
210 Carrier wall base
220 Carrier first leg
230 Carrier second leg
240 Carrier first mount
245 Carrier first mount front side
250 First side pattern
260 Carrier second mount
265 Carrier second mount front side
270 Second side pattern
300 First bracket base plate
310 First bracket base plate front side
320 First bracket base plate rear side
400 Second bracket base plate
410 Second bracket base plate front side
420 Second bracket base plate rear side
500 First bracket extension plate
510 First bracket extension plate front side
520 First bracket extension plate rear side
600 Second bracket extension plate
610 Second bracket extension plate front side
620 Second bracket extension plate rear side
700 Urinal
710 First urinal mount
720 Second urinal mount
900 Bolt
910 Aperture
920 Threaded aperture
930 Set screw
950 First telescopic connector
952 First telescopic connector first end
954 First telescopic connector second end
960 Second telescopic connector
962 Second telescopic connector first end
964 Second telescopic connector second end Referring now to FIGS. 1-4 the present invention features a bracket system (100) for improving the speed and ease of mounting a urinal (700) using a standard urinal carrier (200). In some embodiments, the system comprises a standard urinal carrier (200) comprising a planar carrier wall base (210) located on a vertically projecting carrier first leg (220) and a vertically projecting carrier second leg (230).

In some embodiments, the carrier wall base (210) comprises a carrier first mount (240) comprising a plurality of bolts (900) located on it according to a first side pattern (250) on a carrier first mount front side (245). In some embodiments, the first side pattern (250) is a mated set with a first urinal mount (710). In some embodiments, the plurality of bolts (900) extends from the carrier first mount front side (245) parallel with respect to each other. In some embodiments, the plurality of bolts (900) extends from the carrier first mount front side (245) horizontally at a 90 degree angle with respect to the carrier wall base (210).

In some embodiments, the carrier wall base (210) comprises a carrier second mount (260) comprising a plurality of bolts (900) located on it according to a second side pattern (270) on a carrier second mount front side (265). In some embodiments, the second side pattern (270) is a mated set with a second urinal mount (720). In some embodiments, the plurality of bolts (900) extends from the carrier second mount front side (265) parallel with respect to each other. In some embodiments, the plurality of bolts (900) extends from the carrier second mount front side (265) horizontally at a 90 degree angle with respect to the carrier wall base (210).

In some embodiments, the system (100) comprises a planar first bracket base plate (300) having a first bracket base plate front side (310) and a first bracket base plate rear side (320). In some embodiments, the first bracket base plate (300) comprises a plurality of apertures (910) located in it according to the first side pattern (250). In some embodiments, the plurality of apertures (910) located in the first bracket base plate (300) is a mated set with the plurality of bolts (900) located on the carrier first mount (240).

In some embodiments, the system comprises a first bracket extension plate (500) having a first bracket extension plate front side (510) and a first bracket extension plate rear side (520). In some embodiments, the first bracket extension plate front side (510) comprises a plurality of bolts (900) located on it according to the first side pattern (250). In some embodiments, the plurality of bolts (900) extends from the first bracket extension plate front side (510) parallel with respect to each other. In some embodiments, the plurality of bolts (900) extends from the first bracket extension plate front side (510) horizontally at a 90 degree angle with respect to the first bracket extension plate (500). In some embodiments, the plurality of bolts (900) located on the first bracket extension plate (500) is a mated set with the first urinal mount (710).

In some embodiments, the system (100) comprises a first telescopic connector (950). In some embodiments, the first bracket base plate (300) and the first bracket extension plate (500) are slidably connected via the first telescopic connector (950). In some embodiments, the first telescopic connector (950) is telescopically collapsible. In some embodiments, the first telescopic connector (950) comprises a plurality of threaded apertures (920) having set screws (930) located in them. In some embodiments, the set screws (930) are for affixing the first telescopic connector (950) at a specific length. In some embodiments, a first telescopic connector first end (952) is located on and extends from the first bracket base plate front side (310) perpendicularly at a 90 degree angle with respect to the first bracket base plate (300). In some embodiments, a first telescopic connector second end (954) is located on and extends from a first bracket extension plate rear side (520) perpendicularly at a 90 degree angle with respect to the first bracket extension plate (500).

In some embodiments, the system (100) comprises a planar second bracket base plate (400) having a second bracket base plate front side (410) and a second bracket base plate rear side (420). In some embodiments, the second bracket base plate (400) comprises a plurality of apertures (910) located in it according to the second side pattern (270). In some embodiments, the plurality of apertures (910) located in the second bracket base plate (400) is a mated set with the plurality of bolts (900) located on the carrier second mount (260).

In some embodiments, the system (100) comprises a second bracket extension plate (600) having a second bracket extension plate front side (610) and a second bracket extension plate rear side (620). In some embodiments, the second bracket extension plate front side (610) comprises a plurality of bolts (900) located on it according to the second side pattern (270). In some embodiments, the plurality of bolts (900) extends from the second bracket extension plate front side (610) parallel with respect to each other. In some embodiments, the plurality of bolts (900) extends from the second bracket extension plate front side (610) horizontally at a 90 degree angle with respect to the second bracket extension plate (600). In some embodiments, the plurality of bolts (900) located on the second bracket extension plate (600) is a mated set with the second urinal mount (720).

In some embodiments, the system (100) comprises a second telescopic connector (960). In some embodiments, the second bracket base plate (400) and the second bracket extension plate (600) are slidably connected via the second telescopic connector (960). In some embodiments, the second telescopic connector (960) is telescopically collapsible. In some embodiments, the second telescopic connector (960) comprises a plurality of threaded apertures (920) having set screws (930) located in it. In some embodiments, the set screws (930) are for affixing the second telescopic connector (960) at a specific length. In some embodiments, a second telescopic connector second end (962) is located on and extends from the second bracket base plate front side (410) perpendicularly at a 90 degree angle with respect to the second bracket base plate (400). In some embodiments, a second telescopic connector second end (964) is located on and extends from a second bracket extension plate rear side (620) perpendicularly at a 90 degree angle with respect to the second bracket extension plate (600).

In some embodiments, upon installation of the first bracket base plate (300) on the carrier first mount (240) the plurality of bolts (900) located on the carrier first mount front side (245) is shortened by an installer via a cutting tool or grinding tool. In some embodiments, upon installation of the second bracket base plate (400) on the carrier second mount (260) the plurality of bolts (900) located on the carrier second mount front side (265) is shortened by the installer via the cutting tool or grinding tool.

In some embodiments, the system (100) is constructed from a metal, for example, steel or stainless steel. In some embodiments, the system (100) is coated with a corrosion resistant coating. In some embodiments, the corrosion resistant coating is a plating, for example, cadmium, chrome, or zinc based.

In some embodiments, the first telescopic connector (950) comprises a flat surface on a first inside sliding rod. In some embodiments, the flat surface is for receiving a set screw (930) end surface. In some embodiments, the second telescopic connector (960) comprises a flat surface on a second inside rod. In some embodiments, the flat surface is for receiving a set screw (930) end surface.

In some embodiments, the first telescopic connector (950) comprises a threaded connection. In some embodiments, for adjustment, the first telescopic connector first end (952) is rotated into or out from the first telescopic connector second end (954). In some embodiments, the second telescopic connector (960) comprises a threaded connection. In some embodiments, for adjustment, the second telescopic connector first end (962) is rotated into or out from the second telescopic connector second end (964).

As used herein, the term "about" refers to plus or minus 10% of the referenced number. For example, an embodiment wherein the bracket is about 10 inches in length includes a bracket that is between 9 and 11 inches in length.

The disclosures of the following U.S. patents are incorporated in their entirety by reference herein: U.S. Pat. No. 5,206, 961; U.S. Pat. No. 6,047,515; U.S. Pat. No. 6,065,730; U.S. Pat. No. 6,922,968; U.S. Pat. Pub. No. 2010/0000173; U.S. Design Pat. No. 312,382.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A bracket system (100) for ease of mounting a urinal (700) using a standard urinal carrier (200) comprising:

(a) a standard urinal carrier (200) comprising a planar carrier wall base (210) disposed on a vertically projecting carrier first leg (220) and a vertically projecting carrier second leg (230), wherein the carrier wall base (210) comprises a carrier first mount (240) comprising a plurality of bolts (900) disposed thereon according to a first side pattern (250) on a carrier first mount front side (245), wherein the first side pattern (250) is a mated set with a first urinal mount (710), wherein the plurality of bolts (900) extends from the carrier first mount front side (245) parallel with respect to each other, wherein the plurality of bolts (900) extends from the carrier first mount front side (245) horizontally at a 90 degree angle with respect to the carrier wall base (210), wherein the carrier wall base (210) comprises a carrier second mount (260) comprising a plurality of bolts (900) disposed thereon according to a second side pattern (270) on a carrier second mount front side (265), wherein the second side pattern (270) is a mated set with a second urinal mount (720), wherein the plurality of bolts (900) extends from the carrier second mount front side (265) parallel with respect to each other, wherein the plurality of bolts (900) extends from the carrier second mount front side (265) horizontally at a 90 degree angle with respect to the carrier wall base (210);

(b) a planar first bracket base plate (300) having a first bracket base plate front side (310) and a first bracket base plate rear side (320), wherein the first bracket base plate (300) comprises a plurality of apertures (910) disposed therein according to the first side pattern (250), wherein the plurality of apertures (910) disposed in the first bracket base plate (300) is a mated set with the plurality of bolts (900) disposed on the carrier first mount (240);

(c) a first bracket extension plate (500) having a first bracket extension plate front side (510) and a first bracket extension plate rear side (520), wherein the first bracket extension plate front side (510) comprises a plurality of bolts (900) disposed thereon according to the first side pattern (250), wherein the plurality of bolts (900) extends from the first bracket extension plate front side (510) parallel with respect to each other, wherein the plurality of bolts (900) extends from the first bracket extension plate front side (510) horizontally at a 90 degree angle with respect to the first bracket extension plate (500), wherein the plurality of bolts (900) disposed on the first bracket extension plate (500) is a mated set with the first urinal mount (710);

(d) a first telescopic connector (950), wherein the first bracket base plate (300) and the first bracket extension plate (500) are slidably connected via the first telescopic connector (950), wherein the first telescopic connector (950) is telescopically collapsible, wherein the first telescopic connector (950) comprises a plurality of threaded apertures (920) having set screws (930) disposed therein, wherein the set screws (930) are for affixing the first telescopic connector (950) at a specific length, wherein a first telescopic connector first end (952) is disposed on and extends from the first bracket base plate front side (310) perpendicularly at a 90 degree angle with respect to the first bracket base plate (300), wherein a first telescopic connector second end (954) is disposed on and extends from the first bracket extension plate rear side (520) perpendicularly at a 90 degree angle with respect to the first bracket extension plate (500);

(e) a planar second bracket base plate (400) having a second bracket base plate front side (410) and a second bracket base plate rear side (420), wherein the second bracket base plate (400) comprises a plurality of apertures (910) disposed therein according to the second side pattern (270), wherein the plurality of apertures (910) disposed in the second bracket base plate (400) is a mated set with the plurality of bolts (900) disposed on the carrier second mount (260);

(f) a second bracket extension plate (600) having a second bracket extension plate front side (610) and a second bracket extension plate rear side (620), wherein the second bracket extension plate front side (610) comprises a plurality of bolts (900) disposed thereon according to the second side pattern (270), wherein the plurality of bolts (900) extends from the second bracket extension plate front side (610) parallel with respect to each other, wherein the plurality of bolts (900) extends from the second bracket extension plate front side (6110) horizontally at a 90 degree angle with respect to the second bracket extension plate (600), wherein the plurality of bolts (900) disposed on the second bracket extension plate (600) is a mated set with the second urinal mount (720);

(g) a second telescopic connector (960), wherein the second bracket base plate (400) and the second bracket extension plate (600) are slidably connected via the second telescopic connector (960), wherein the second telescopic connector (960) is telescopically collapsible, wherein the second telescopic connector (960) comprises a plurality of threaded apertures (920) having set screws (930) disposed therein, wherein the set screws (930) are for affixing the second telescopic connector (960) at a specific length, wherein a second telescopic connector second end (962) is disposed on and extends from the second bracket base plate front side (410) perpendicularly at a 90 degree angle with respect to the second bracket base plate (400), wherein a second telescopic connector second end (964) is disposed on and extends from the second bracket extension plate rear side (620) perpendicularly at a 90 degree angle with respect to the second bracket extension plate (600);

wherein upon installation of the first bracket base plate (310) on the carrier first mount (240) the plurality of bolts (900) disposed on the carrier first mount front side (245) is shortened by an installer via a cutting tool or grinding tool, wherein upon installation of the second bracket base plate (400) on the carrier second mount (260) the plurality of bolts (900) disposed on the carrier second mount front side (265) is shortened by the installer via, the cutting tool or grinding tool.

2. The system (100) of claim 1, wherein the system (100) is constructed from a metal.

3. The system (100) of claim 1, wherein the system (100) is coated with a corrosion resistant coating.

4. The system (100) of claim 1, wherein the first telescopic connector (950) comprises a flat surface on a first inside sliding rod, wherein the flat surface is for receiving a set screw (930) end surface.

5. The system (100) of claim 1, wherein the second telescopic connector (960) comprises a flat surface on a second inside rod, wherein the flat surface is for receiving a set screw (930) end surface.

6. The system (100) of claim 1, wherein the first telescopic connector (950) comprises a threaded connection, wherein for adjustment, the first telescopic connector first end (952) is rotated into or out from the first telescopic connector second end (954).

7. The system (100) of claim 1, wherein the second telescopic connector (960) comprises a threaded connection, wherein for adjustment, the second telescopic connector first end (962) is rotated into or out from the second telescopic connector second end (964).

* * * * *